US006857734B2

(12) United States Patent
Yamamoto

(10) Patent No.: US 6,857,734 B2
(45) Date of Patent: Feb. 22, 2005

(54) INK JET PRINTER AND METHOD OF HARDENING INK FOR THE PRINTER

(75) Inventor: Yasuo Yamamoto, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 28 days.

(21) Appl. No.: 10/362,595

(22) PCT Filed: Aug. 29, 2001

(86) PCT No.: PCT/JP01/07436

§ 371 (c)(1),
(2), (4) Date: Feb. 24, 2003

(87) PCT Pub. No.: WO02/18143

PCT Pub. Date: Mar. 7, 2002

(65) Prior Publication Data

US 2003/0164870 A1 Sep. 4, 2003

(30) Foreign Application Priority Data

Aug. 29, 2000 (JP) ..... 2000-258730
Aug. 28, 2001 (JP) ..... 2001-257783

(51) Int. Cl.[7] ..... B41J 2/01
(52) U.S. Cl. ..... 347/102
(58) Field of Search ..... 347/102

(56) References Cited

FOREIGN PATENT DOCUMENTS

| | | | | |
|---|---|---|---|---|
| JP | 63-062738 | | 3/1988 | |
| JP | 63062738 A | * | 3/1988 | ..... B41J/3/04 |
| JP | 03-065345 | | 3/1991 | |
| JP | 05-124193 | | 5/1993 | |
| JP | 07-224241 | | 8/1995 | |
| JP | 11-320856 | | 11/1999 | |

* cited by examiner

*Primary Examiner*—Stephen D. Meier
*Assistant Examiner*—Ly T Tran
(74) *Attorney, Agent, or Firm*—Nath & Associates PLLC; Marvin C. Berkowitz; Derek Richmond

(57) ABSTRACT

An inkjet printer for printing a print paper (3) by ejecting a UV-curing type ink through an inkjet print head (5) incorporates an ultraviolet irradiation device (A) for irradiating the ultraviolet light to a target ink position following the ejection of the UV-curing type ink. The device (A) has an ultraviolet light generator (10) for generating the ultraviolet light and optical fibers (11*a*, 11*b*) through which the ultraviolet light is guided to a position close to the inkjet print head (5). The ultraviolet light is irradiated through tips of the optical fibers (11*a*, 11*b*) in order to cure the UV-curing type ink.

12 Claims, 12 Drawing Sheets

INK JET PRINTER AND METHOD OF HARDENING INK FOR THE PRINTER

TECHNICAL FIELD

The present invention relates to an inkjet printer and an ink curing method thereof capable of performing printing by ejecting photo-curing type ink through an inkjet print head.

BACKGROUND ART

Inkjet printers perform printing by ejecting ink onto a print media through one or more inkjet print heads. Because it becomes difficult to eject the ink through the inkjet print head when the viscosity of the ink is increased or the ink is cured by the evaporation of a solvent, conventional methods using various improved techniques for ink have been proposed in order to avoid any occurrence of curing of the ink, for example, to add an anti-evaporation agent to aqueous ink, or to use high-boiling point oily ink.

However, the use of those improved inks requires long drying time when a print media of low permeability is used. In addition, when the printed matter is contacted to a component part of the printer body during printing, or when the printed surfaces of the print medias stacked are contacted to each other immediately following the completion of printing, the printed image on the print media is disturbed. In order to prevent the occurrence of such disturbance, inkjet printers using UV-curing type ink have been proposed.

Such a conventional inkjet printer comprises an inkjet print head for ejecting an UV-curing type ink onto a print media, a carrying means for carrying the print media printed through the inkjet print head to an ultraviolet irradiation device, and the ultraviolet irradiation device for irradiating ultraviolet light (For example, see the patent document of Japanese laid open publication number JP-7-224241). This inkjet printer can avoid the occurrence of disturbance of the printed image on the print media even if user's fingers touch it, because in order to cure the ink the inkjet printer irradiates the ultraviolet light onto the UV-curing type ink, which has been ejected, on the print media.

However, this kind of the conventional inkjet printer requires the carrying means for carrying a printed print media after printing process to the irradiation position where the ultraviolet irradiation device is placed. It is further necessary to have a configuration in which the printed surface of the print media is not contacted to any component part of the carrying means during carrying the print media to the ultraviolet irradiation device. Furthermore, the conventional inkjet printers require a longer total-printing time because it must be necessary to perform the carrying process for the printed matter to the ultraviolet irradiation device and the irradiation process of ultraviolet light after the completion of the printing through the inkjet print head.

Moreover, the ultraviolet irradiation device in the conventional inkjet printer requires an ultraviolet lamp of high power because the ultraviolet irradiation device must irradiate the ultraviolet light of a predetermined amount to the entire print surface of the print media and it must be necessary to equip a heat protection means for protecting the device against a large heat generated by the ultraviolet lamp. Therefore the manufacturing cost of the conventional inkjet printer becomes high and the size thereof becomes large.

Accordingly, an object of the present invention is, with due consideration to the drawbacks of the conventional technique, to provide an inkjet printer and an ink curing method thereof capable of reducing a total printing time without incorporating any carrying means to carry a print media after the completion of a printing process.

In addition, another object of the present invention is to provide an inkjet printer and an ink curing method thereof using an ultraviolet irradiation device of a small size, a low cost, a low power consumption, and capable of reducing a total printing time without incorporating any carrying means to carry a print media after the completion of a printing process.

DISCLOSURE OF INVENTION

In carrying out the invention and according to one aspect thereof, there is provided an inkjet printer having an inkjet print head through which a photo-curing type ink is ejected onto a print media in a printing process. The inkjet printer comprises a photo-irradiation device that irradiates a beam of light to a target ink position on the print media onto which the photo-curing type ink has been ejected while following the ejection of the photo-curing type ink through the inkjet print head. Accordingly, when the photo-curing type ink is ejected onto the print media through the inkjet print head, the beam of light follows the target ink position on the print media in order to cure the ejected photo-curing type ink.

In addition, in the inkjet printer described above, the photo-curing type ink is an UV (ultraviolet)-curing type ink, and the photo-irradiation device is an ultraviolet irradiation device. Accordingly, when the UV-curing type ink is ejected onto the print media through the inkjet print head, the beam of ultraviolet light follows the target ink position on the print media in order to cure the UV-curing type ink.

Furthermore, in the inkjet printer described above, the ultraviolet irradiation device comprises an ultraviolet light generation section for generating the ultraviolet light and one or more optical fibers through which the ultraviolet light generated by the ultraviolet light generation section is guided to a position close to the ink jet print head. In the ink jet printer, the ultraviolet irradiation device irradiates the ultraviolet light onto the print media through the tips of the optical fibers. Accordingly, in addition to the action described above, because the beam of the ultraviolet light can be irradiated from a position close to the print media to an narrow area including the target ink position on the print media, the ultraviolet irradiation device of low in power can adequately irradiate the ultraviolet light of a desired amount to the target ink position.

Moreover, in the inkjet printer described above, the tips of the optical fibers are coupled in motion to a print speed of the inkjet print head and are set movably in a main scanning direction of the inkjet print head so that the ultraviolet light is irradiated onto the target ink position on the print media immediately following the ejection of the UV-curing type ink. Accordingly, in addition to the action described above, it is not necessary to shift the ultraviolet light generation section and it is enough to shift only the tips of the optical fibers.

Furthermore, in the inkjet printer described above, a mean shifting speed H1 of the tip of each optical fiber in the main scanning direction of the inkjet print head is given by the expression $H \geqq W1 \times V1/D$, when the inkjet print head is a serial scanning on-demand type head, wherein W1 is a print width in a sub scanning direction, V1 is a relative speed between the inkjet print head and the print media in the main scanning direction, and D is an irradiation diameter of each optical fiber. Accordingly, in addition to the action described above, it is possible to irradiate the ultraviolet light to the entire area of the target ink position, onto which the UV-curing type ink has been ejected, immediately following this ejection of the UV-curing type ink through the inkjet print head as the serial scanning on-demand type head.

In addition, in the inkjet printer described above, a mean shifting speed H2 of the tip of each optical fiber in the main scanning direction of the inkjet print head is given by the expression $H2 \geqq W2 \times V2/D$, when the inkjet print head is a line scanning on-demand head, wherein W2 is a print width in the main scanning direction, V2 is a relative speed between the inkjet print head and the print media in a sub scanning direction, and D is an irradiation diameter of each optical fiber. Accordingly, in addition to the action described above, it is possible to irradiate the ultraviolet light to the entire area of the target ink position, onto which the UV-curing type ink has been ejected, immediately following this ejection of the UV-curing type ink through the inkjet print head as the line scanning on-demand type head.

Furthermore, in the inkjet printer described above, the inkjet print head is a serial scanning on-demand type head, and the irradiation diameter of each optical fiber is equal to or greater than the print width of the inkjet print head in the sub scanning direction per scanning of the inkjet print head, and the tip of each optical fiber is fixed to the inkjet print head in order to shift them together. Accordingly, in addition to the action described above, it is not necessary to incorporate any additional fiber shifting means to shift the tips of the optical fibers.

Moreover, in the inkjet printer described above, the optical fibers are a duplex optical fiber system, and the tips of the optical fibers in the duplex optical fiber system are set on both ends of the inkjet print head in the main scanning direction. Accordingly, in addition to the action described above, when a duplex optical fiber system performs the irradiation in each scanning direction of the inkjet print head performing a reciprocating motion in the main scanning direction, it is possible to irradiate the ultraviolet light to the entire of the print width in the main scanning direction immediately following the ejection of the ink even if the inkjet print head scans bi-directionally.

Moreover, in the inkjet printer described above, when the inkjet print head is a serial scanning on-demand type head, at least "n" optical fibers are arranged parallel with one end of the inkjet print head in the main scanning direction so as to satisfy the expression $W1 \leqq n \times D$ under the condition of $W1 > D$, where W1 is a print width in the sub scanning direction of the inkjet print head, and D is an irradiation diameter of each optical fiber. Accordingly, in addition to the action described above, even if the tips of the optical fibers are fixed to the inkjet print head when the irradiation diameter of the optical fiber is smaller than the print width of the inkjet print head in the sub scanning direction, it is possible to irradiate the ultraviolet light to the entire area of the target ink position immediately following the ejection of the ink even if the inkjet print head scans bi-directionally.

Furthermore, in the inkjet printer described above, when the inkjet print head is a line scanning on-demand type head, "m" optical fibers are arranged parallel with the main scanning direction of the inkjet print head in the downstream side of the sub scanning direction thereof so as to satisfy the expression $m \times D \geqq W2$, where W2 is a print width in the main scanning direction of the inkjet print head, and D is an irradiation diameter of each optical fiber. Accordingly, in addition to the action described above, even if the tips of the optical fibers are fixed to the inkjet print head when the inkjet print head is a line scanning on-demand type head, it is possible to irradiate the ultraviolet light to the entire area of the target ink position immediately following the ejection of the ink even if the inkjet print head scans bi-directionally.

In accordance with another embodiment of the present invention, an ink curing method of an inkjet printer having an inkjet print head comprises following steps. A photo-curing type ink is ejected on a print media through the inkjet print head. A beam of light is irradiated to a target ink position on the print media by a photo-irradiation device. The photo-curing type ink has been ejected on the print media by the optical irradiation device immediately following the ejection of the photo-curing type ink in order to cure the photo-curing type ink at the target ink position on the print media. Accordingly, when the photo-curing type ink is ejected to the print media through the inkjet print head, the beam of light follows the target ink position in order to cure the photo-curing type ink.

In addition, in the ink curing method described above, the photo-curing type ink is an UV-curing type ink, and the photo-irradiation device is an ultraviolet irradiation device. Accordingly, when the UV-curing type ink is ejected to the print media through the inkjet print head, the beam of ultraviolet light follows the target ink position in order to cure the UV-curing type ink.

Furthermore, in the ink curing method described above, the ultraviolet irradiation device comprises an ultraviolet light generation section for generating the ultraviolet light and one or more optical fibers through which the ultraviolet light is guided to a position close to the inkjet print head and the ultraviolet light is irradiated through the tips of the optical fibers. Accordingly, in addition to the action described above, because the beam of the ultraviolet light is irradiated from a position close to the print media to an narrow area including the target ink position on the print media, the ultraviolet irradiation device of low power can irradiate the ultraviolet light of a desired amount to the target ink position.

Moreover, in the ink curing method described above, in addition to the action described above, the tips of the optical fibers are coupled in motion to a print speed of the inkjet print head and are set movably in a main scanning direction so that the ultraviolet light is irradiated onto the target ink position on the print media immediately following the ejection of the UV-curing type ink. Accordingly, in addition to the action described above, it is not necessary to shift the ultraviolet light generation section and it is enough to shift only the tips of the optical fibers.

Further, in the ink curing method described above, in addition to the action described above, a mean shifting speed H1 of the tip of each optical fiber in the main scanning direction is given by the expression $H1 \geqq W1 \times V1/D$, when the inkjet print head is a serial scanning on-demand type head, wherein W1 is a print width in a sub scanning direction, V1 is a relative speed between the inkjet print head and the print media in the main scanning direction, and D is an irradiation diameter of each optical fiber. Accordingly, in addition to the action described above, it is possible to irradiate the ultraviolet light to the entire area of the target ink position, onto which the UV-curing type ink has been ejected, immediately following this ejection of the UV-curing type ink through the inkjet print head as the serial scanning on-demand type head.

Moreover, in the ink curing method described above, a mean shifting speed H2 of the tip of each optical fiber in the main scanning direction is given by the expression $H2 \geqq W2 \times V2/D$, when the inkjet print head is a line scanning on-demand head, wherein W2 is a print width in the main scanning direction, V2 is a relative speed between the inkjet print head and the print media in a sub scanning direction, and D is an irradiation diameter of each optical fiber. Accordingly, in addition to the action described above, it is possible to irradiate the ultraviolet light to the entire area of the target ink position, onto which the UV-curing type ink has been ejected, immediately following this ejection of the UV-curing type ink through the inkjet print head as the line scanning on-demand type head.

Furthermore, in the ink curing method described above, the inkjet print head is a serial scanning on-demand type head, and the irradiation diameter of each optical fiber is equal to or greater than the print width of the inkjet print head in the sub scanning direction per scanning of the inkjet print head, and the tip of each optical fiber is fixed to the inkjet print head in order to shift them together. Accordingly, in addition to the action described above, it is not necessary to incorporate any additional fiber shifting means to shift the tips of the optical fibers.

Moreover, in the ink curing method described above, the optical fibers are a duplex optical fiber system, and the tips of the optical fibers in the duplex optical fiber system are set on both ends of the inkjet print head in the main scanning direction. Accordingly, in addition to the action described above, when a duplex optical fiber system performs the irradiation in each scanning direction of the inkjet print head performing a reciprocating motion in the main scanning direction, it is possible to irradiate the ultraviolet light to the entire of the print width in the main scanning direction immediately following the ejection of the ink even if the inkjet print head scans bi-directionally.

Further, in the ink curing method described above, when the inkjet print head is a serial scanning on-demand type head, at least, "n" optical fibers are arranged parallel with one end of the inkjet print head in the main scanning direction so as to satisfy the expression $W1 \leqq n \times D$ under the condition of $W1 > D$, where W1 is a print width in the sub scanning direction of the inkjet print head, and D is an irradiation diameter of each optical fiber. Accordingly, in addition to the action described above, even if the tips of the optical fibers are fixed to the inkjet print head when the irradiation diameter of the optical fiber is smaller than the print width of the inkjet print head in the sub scanning direction, it is possible to irradiate the ultraviolet light to the entire area of the target ink position immediately following the ejection of the ink even if the inkjet print head scans bi-directionally.

Furthermore, in the ink curing method described above, when the inkjet print head is a line scanning on-demand type head, "m" optical fibers are arranged parallel with the main scanning direction of the inkjet print head in the downstream side of the sub scanning direction thereof so as to satisfy the relationship $m \times D \geqq W2$, where W2 is a print width in the main scanning direction of the inkjet print head, and D is an irradiation diameter of each optical fiber. Accordingly, in addition to the action described above, even if the tips of the optical fibers are fixed to the inkjet print head when the inkjet print head is a line scanning on-demand type head, it is possible to irradiate the ultraviolet light to the entire area of the target ink position immediately following the ejection of the ink even if the inkjet print head scans bi-directionally.

BEST MODE FOR CARRYING OUT THE INVENTION

The best mode for carrying out the present invention will now be described in detail with reference to the accompanying drawings.

First Embodiment

Figure 1:
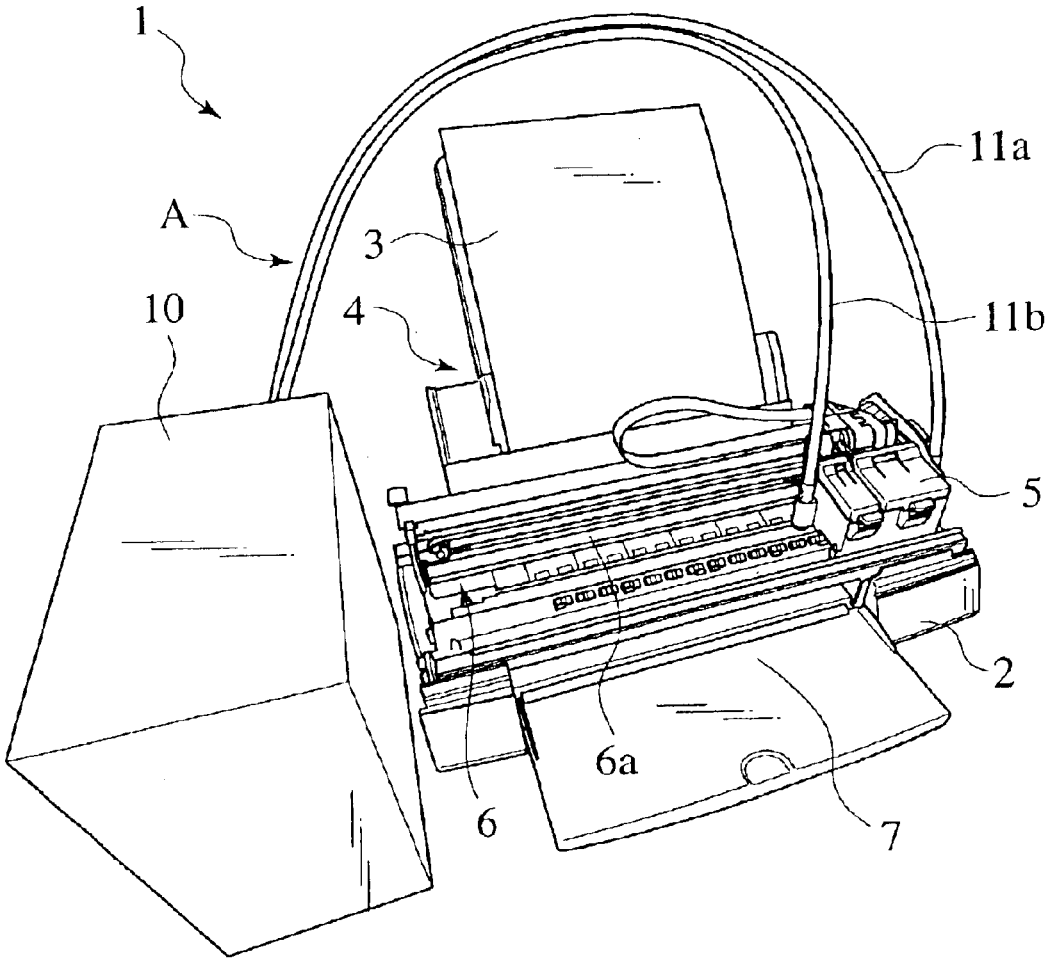
FIG. 1 is a perspective view of an entire configuration of an inkjet printer according to the first embodiment of the present invention.
Figure 2:
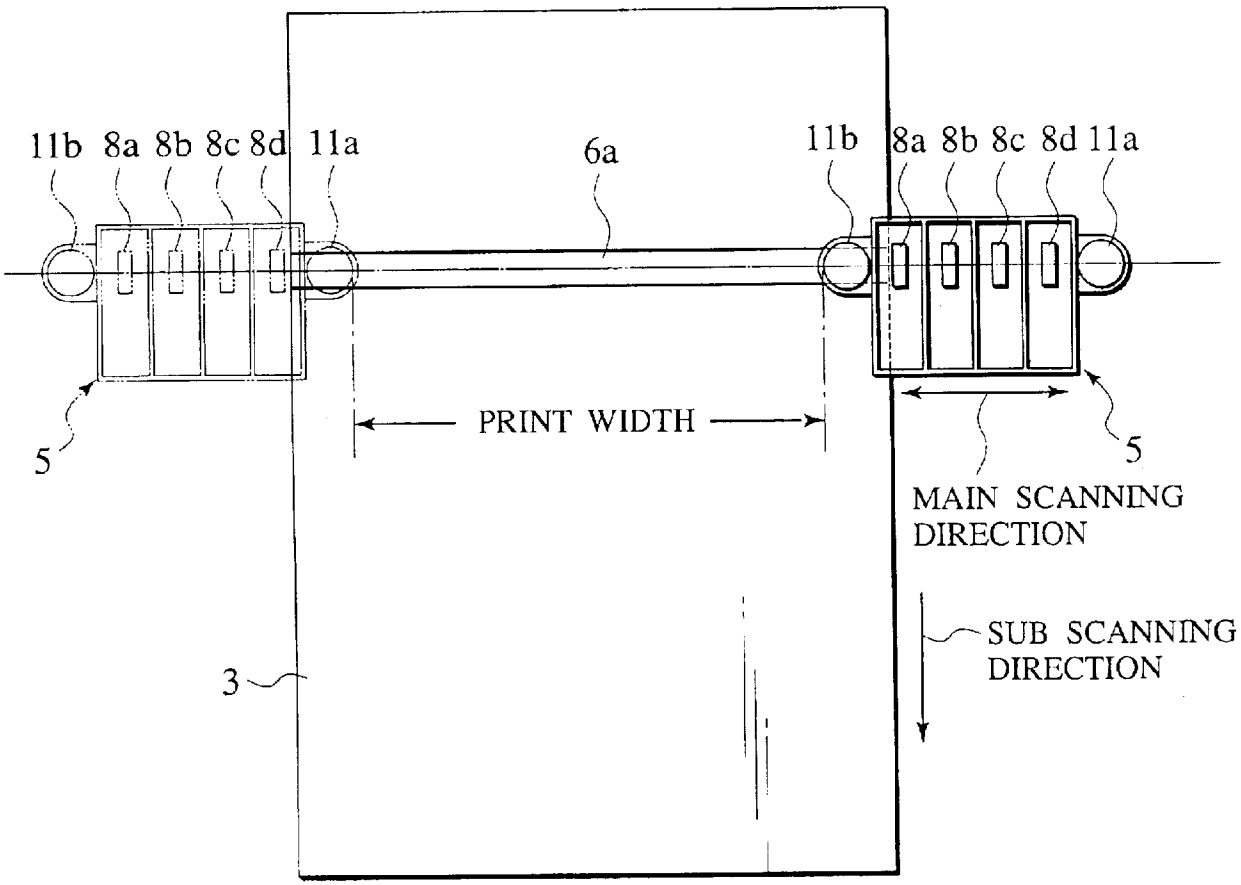
FIG. 2 is a schematic plane view showing a relationship in position between an inkjet print head and tips of optical fibers according to the first embodiment of the present invention.
Figure 3:
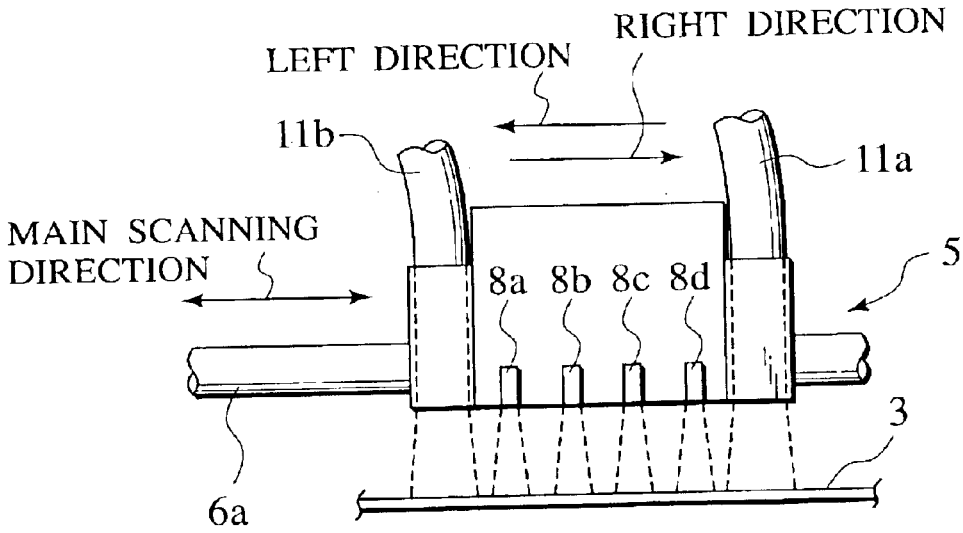
FIG. 3 is a schematic elevation view showing a relationship in position between the inkjet print head and the tips of the optical fibers according to the first embodiment of the present invention.
Figure 4:
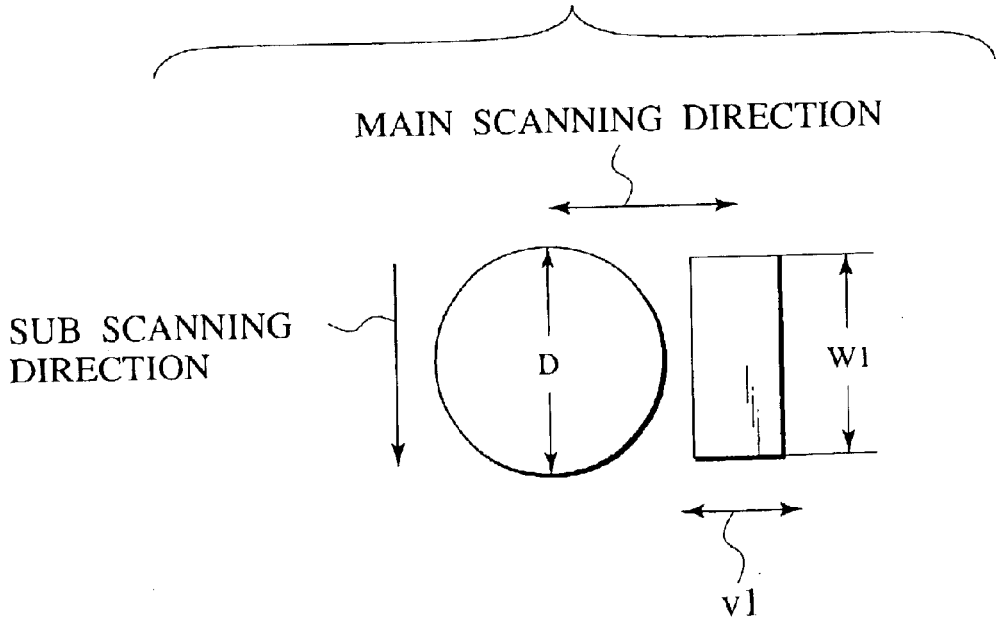
FIG. 4 is a view showing a print width of the inkjet print head and an irradiation diameter of the optical fiber in the first embodiment of the present invention.

FIG. 1 to FIG. 4 show an inkjet printer and an ink curing method according to the first embodiment of the present invention. FIG. 1 is a perspective view of the entire configuration of the inkjet printer 1. FIG. 2 is a schematic plane view showing a relationship in position between an inkjet print head 5 and tips of optical fibers 11*a* and 11*b*. FIG. 3 is a schematic elevation view showing a relationship in position between the inkjet print head 5 and the tips of the optical fibers 11*a* and 11*b*. FIG. 4 is a view showing a print width of the inkjet print head 5 in a sub scanning direction and an irradiation diameter of each of the optical fibers 11*a* and 11*b*.

In FIG. 1, the inkjet printer 1 comprises a paper feed section 4, a paper carrying means (not shown), an inkjet print head 5, a ultraviolet irradiation device A, and a paper ejecting section 7. The paper feed section 4 is arranged at the upper section of an inkjet printer body 2 and where a print paper 3 as a print media is set. The paper carrying means (not shown) carries the print paper 3 that has been set in the paper feed section 4 in a sub scanning direction (which is the same direction as the carrying direction of the print paper 3) of the inkjet print head 5 with a predetermined speed. The inkjet print head 5 prints the print paper 3 carried by the paper carrying means.

The ultraviolet irradiation device A as a photo-irradiation device irradiates ultraviolet light onto a target ink position on the print paper 3 onto which UV-curing type ink (photo-curing type ink) has been ejected by the inkjet print head 5. The paper ejecting section 7 ejects the print paper 3 that has been printed by the inkjet print head 5.

The inkjet print head 5 is a serial scanning on-demand type head. This inkjet print head 5 is movable between the position designated by the solid line and the position designated by the two-dot chain lines (as the virtual line) shown in FIG. 2 in a main scanning direction (that is perpendicular to the carrying direction of the print paper 3) along a guide rod 6*a* in a head shifting means 6.

The shifting range of the inkjet print head 5 is so set that the optical fiber 11*b* at the left side of the position designated by the solid line shown in FIG. 2 and the optical fiber 11*a* at the right side in the position designated by the two-dot chain lines shown in FIG. 2 are at least out of the print width in the print paper 3.

The inkjet print head 5, as shown in FIG. 3, comprises four nozzle head sections 8*a* to 8*d* of an inkjet type, which are arranged at the positions against the print paper 3 in order to eject four-color UV-curing type inks, yellow, magenta, cyan, and black, corresponding to each of the nozzle head sections 8*a* to 8*d*, respectively. The ejecting timing of each of the nozzle head sections 8*a* to 8*d* is controlled based on ejecting data.

The UV-curing type ink as one kind of photo-curing type ink is a composite material containing a photo curable prepolymer, a photo curable monomer, and a photo initiator.

A photo curable prepolymer used in the manufacture of the UV-curing type resin is used in this embodiment as the photo curable prepolymer. One or more kinds of photo curable prepolymers and monomers are mixed and one or more kinds of photo initiators are then added to the mixed one. According to demands, a polymerization inhibitor, a photosensitizer, a colorant, and an activator are added.

In FIG. 1, the ultraviolet irradiation device A comprises an ultraviolet light generation section 10 incorporating an ultraviolet source lamp (not shown) for generating ultraviolet light, and both the optical fibers 11*a* and 11*b* as a duplex optical fiber system, through which the ultraviolet light generated by the ultraviolet light generation section 10 is guided. The tips of both the optical fibers 11*a* and 11*b* as a duplex optical fiber system are fixed on both sides of the inkjet print head 5 in the main scanning direction.

Because both the optical fibers 11*a* and 11*b* have a flexibility, each of the optical fibers 11*a* and 11*b* changes the amount of their flexure according to the shift of the inkjet print head 5 in order to move the tips of them together with the inkjet print head 5 in the main scanning direction.

Next, a description will be given of the relationship between the target ink position on the print paper 3 onto which the ink has been ejected from the inkjet print head 5 and the irradiation position of the ultraviolet light through the optical fibers 11*a* and 11*b*.

In FIG. 3, when the inkjet print head 5 is moved from right to left, the optical fiber 11*a* of the right side irradiates the ultraviolet light onto the target ink position immediately following the ejection of the ink. In addition, when the inkjet print head 5 is moved from left to right, the optical fiber 11*b* of the left side irradiates the ultraviolet light onto the target ink position immediately following the ejection of the ink. That is, it is so arranged that the optical fibers 11*a* and 11*b* as the duplex optical fiber system irradiate the ultraviolet light in the scanning directions of the inkjet print head 5, respectively.

As shown in FIG. 4, the expression $W1 \leqq D$ is given where W1 is a print width in the sub scanning direction per scanning of the inkjet print head 5, and D is an irradiation diameter of each of the optical fibers 11*a* and 11*b*.

In the configuration of the inkjet printer described above, the ultraviolet light follows the target ink position on the print paper 3 onto which the inkjet print head 5 has ejected the UV-curing type ink. By the irradiation of the ultraviolet light, the UV-curing type ink can be cured immediately following the ejection of the UV-curing type ink. Accordingly, it is not necessary for the inkjet printer of the present invention to incorporate any carrying means for carrying the print paper 3 to the ultraviolet irradiation device after the completion of the printing process. On the contrary, the conventional inkjet printer must incorporate this kind of the carrying means. The inkjet printer of the present invention can therefore reduce the total printing time. In general, because the ink of low viscosity is widely used from the standpoint of the easy ink-ejection of the inkjet print head 5, this ink is easily blurred into the print paper 3. On the contrary, because the ultraviolet light is irradiated onto the target ink position on the print paper immediately following the ejection of the UV-curing type ink, it is possible to prevent any occurrence of ink-blur permeation in the print paper 3 even if the UV-curing type ink of low viscosity is used. The present invention can provide printed matters having anti-rubbing property even if the surface of the printed matter is touched immediately following the completion of printing. In the same reason, even if the print paper of easy-blur property is used, it is possible to eliminate any ink-blur phenomenon. This can provide printed matters having anti-rubbing property.

In the first embodiment, the ultraviolet irradiation device A comprises the ultraviolet light generation section 10 for generating ultraviolet light, and the optical fibers 11*a* and 11*b* through which the ultraviolet light generated by the ultraviolet light generation section 10 is guided to the position close to the inkjet print head 5. Because abeam of the ultraviolet light may be irradiated to a narrow area on the print paper 3 close to the target ink position onto which the ink has been ejected through both the tips of the optical fibers 11*a* and 11*b*, and because the ultraviolet light of a desired amount can be irradiated even if the ultraviolet light generation device of a low power is used, it is possible to use the ultraviolet irradiation device A of a small size with a low manufacturing cost and with a low power consumption. Furthermore, because it is not necessary to prepare the ultraviolet source lamp whose length corresponding to the print width and not necessary to shift the ultraviolet source lamp itself, the inkjet printer of the present invention is excellent in safety and durability.

In the first embodiment, because both the tips of the optical fibers 11*a* and 11*b* can be shifted at the same speed of the inkjet print head 5 in the main scanning direction so that the beam of the ultraviolet light scans the target ink position immediately following the ejection of the UV-curing type ink, it is not necessary to shift the ultraviolet generation section 10. Thus, because it is enough to shift only the tips of the optical fibers 11*a* and 11*b*, it can be easily achieved to control the irradiation of the ultraviolet light following the ejection of the UV-curing type ink. In particularly, in the first embodiment, because it is so set that the irradiation diameter D of each of the optical fibers 11*a* and 11*b* is equal to or more than the print width W1 in the sub scanning direction of the inkjet print head 5 and both the tips of the optical fibers 11*a* and 11*b* are fixed to the inkjet print head 5, the tips of the optical fibers 11*a* and 11*b* are coupled in motion to the same printing speed of the inkjet print head 5. Accordingly, it is not necessary to incorporate any optical fiber shifting means by which the tips of the optical fibers 11*a* and 11*b* are shifted in addition to the head shifting means 6. This can prevent the increasing of the number of component parts in the inkjet printer. Furthermore, the inkjet printer of the first embodiment can achieve the easily printing control because it is not necessary to control the shifting of the tips of the optical fibers 11*a* and 11*b*.

In the first embodiment, the inkjet printer has the duplex optical fiber system comprising the optical fibers 11*a* and 11*b*, the tips of them are arranged on the corresponding both ends of the inkjet print head 5 in the main scanning direction, and both the optical fibers 11*a* and 11*b* of the duplex optical fiber system can irradiate the ultraviolet light in each scanning direction of the inkjet print head 5. Accordingly, it is possible to irradiate the ultraviolet light onto the entire area of the print width on the print paper 3 in the main scanning direction immediately following the ejection of the UV-curing type ink even if the inkjet print head 5 moves in each scanning direction. Accordingly, it is possible to cure the UV-curing type ink without changing of the irradiation position of the ultraviolet light through the tips of the optical fibers 11*a* and 11*b*.

Second Embodiment

Figure 5:
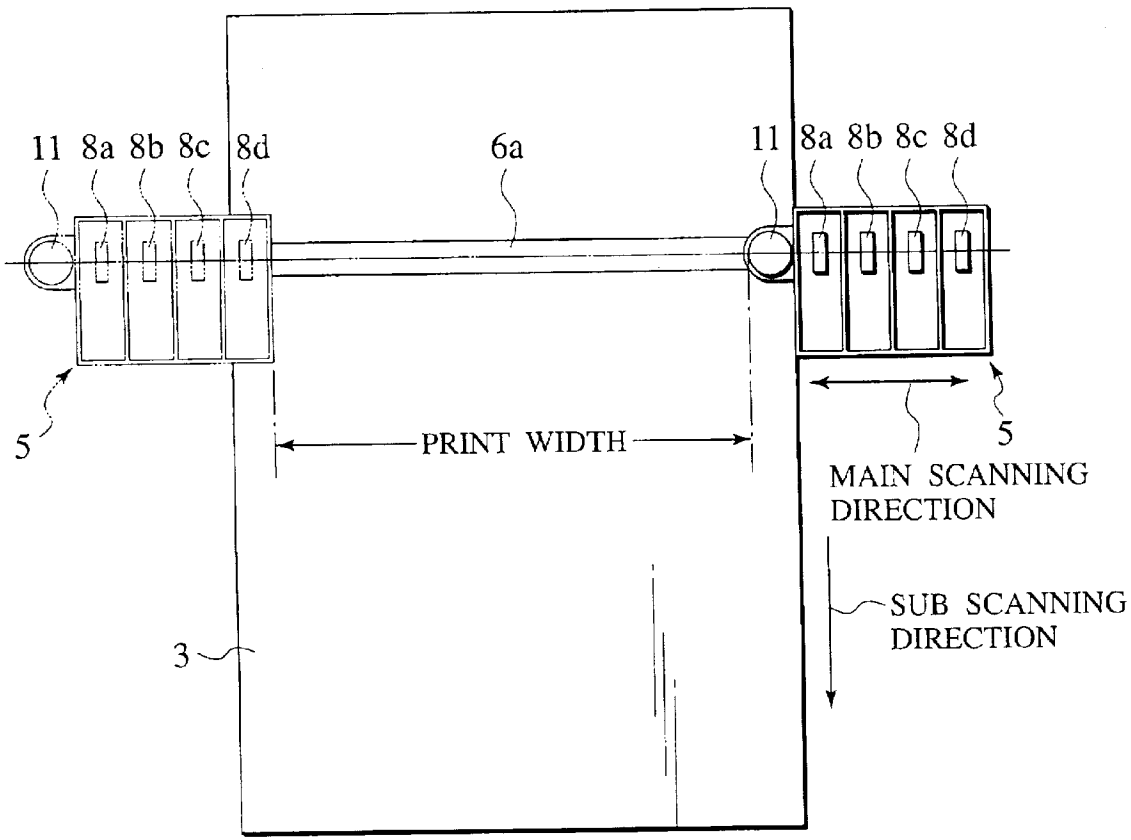
FIG. 5 is a schematic plane view showing a relationship in position between an ink jet print head and the tip of the optical fibers according to the second embodiment of the present invention.

FIG. 5 is a schematic plane view showing a relationship in position between the inkjet print head 5 and the tip of the optical fiber 11 according to the second embodiment of the present invention.

When compared with the configuration of the first embodiment, the second embodiment shown in FIG. 5 comprises one optical fiber system including only the optical fiber 11. Other configuration of the second embodiment is the same as that of the first embodiment.

The second embodiment can obtain the same action and effect of the first embodiment. In particularly, in order to apply the inkjet print head for performing the reciprocation (two-way) printing in the main scanning direction, it is necessary to change the irradiation position of the ultraviolet light irradiated through the tip of the optical fiber 11 so that the ultraviolet light is effectively irradiated immediately following the ejection of the ink every scanning of both the directions. That is, the irradiation position of the optical fiber 11 is changed according to the scanning direction of the inkjet print head 5 so that the tip of the optical fiber 11 can irradiate certainly the ultraviolet light onto the target ink position. In a case of the inkjet print head 5 performing only one direction printing in the main scanning direction, needless to say, it is not necessary to change the irradiation position of the ultraviolet light through the tip of the optical fiber 11.

Third Embodiment

Figure 6:
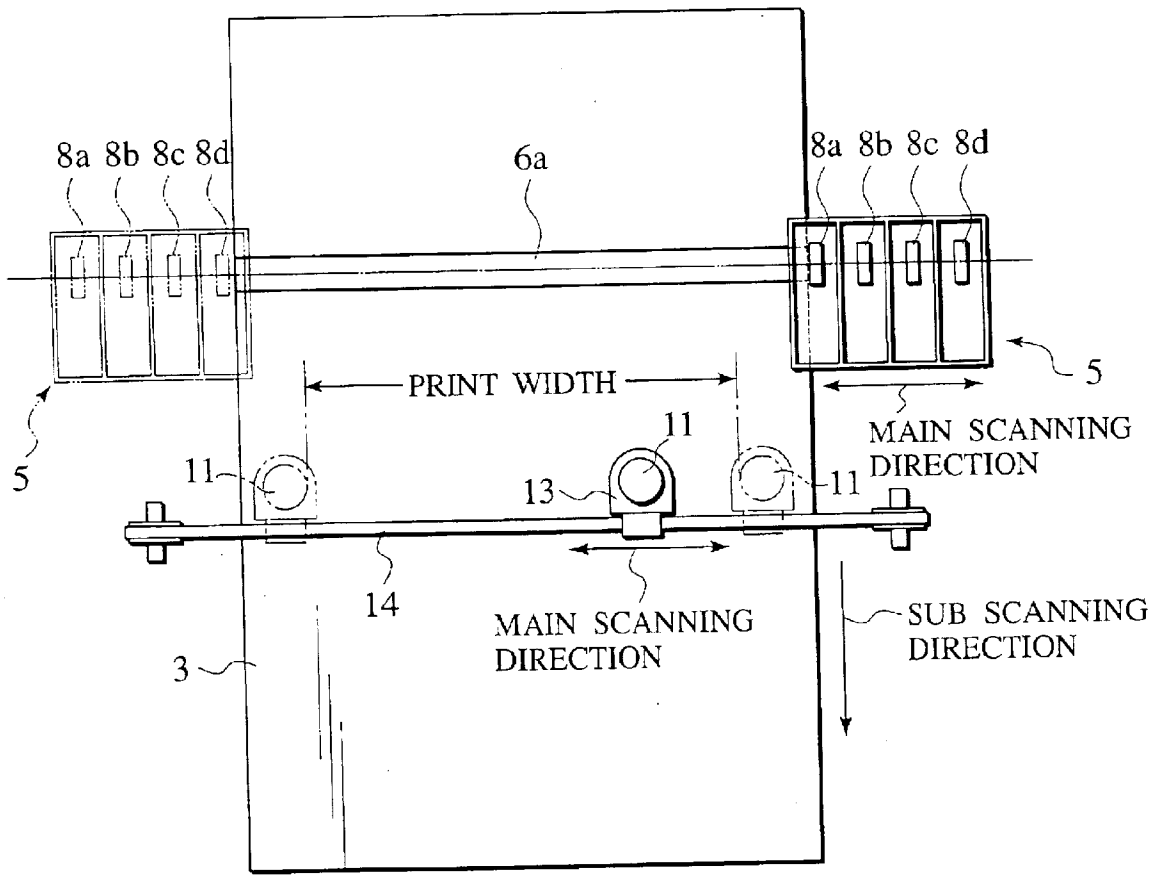
FIG. 6 is a schematic plane view showing a relationship in position between an inkjet print head and the tip of an optical fiber according to the third embodiment of the present invention.
Figure 7:
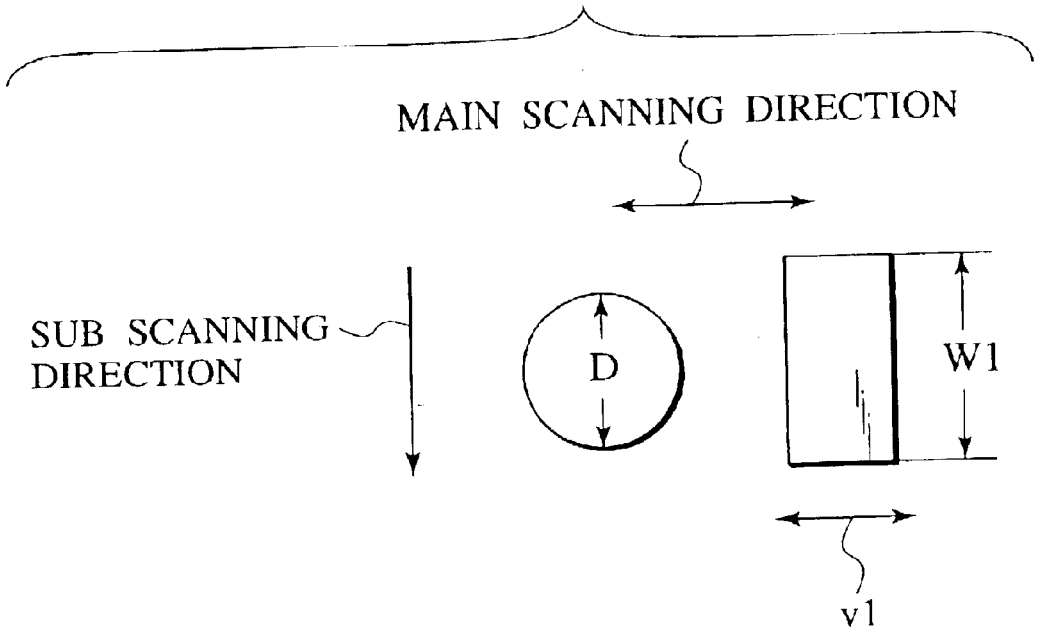
FIG. 7 is a view showing a print width of the inkjet print head and an irradiation diameter of the optical fiber according to the third embodiment of the present invention.

Both FIG. 6 and FIG. 7 show the third embodiment of the present invention. FIG. 6 is a schematic plane view showing a relationship in position between the inkjet print head 5 and the tip of the optical fiber 11. FIG. 7 is a view showing a print width of the inkjet print head 5 in a sub-scanning direction and an irradiation diameter of the optical fiber 11.

In FIG. 6, like the first embodiment described above, the inkjet print head 5 is a serial scanning on-demand type head, shifted in the main scanning direction by the head shifting means (not shown).

In addition, like the configuration of the second embodiment described above, the third embodiment has one optical fiber system including only one optical fiber 11. The tip of the optical fiber 11 is fixed to the fiber shifting member 13 arranged at the downstream side close to the inkjet print head 5 in the sub-scanning direction. The fiber shifting member 13 is fixed to the movable belt 14, and shifted in the main scanning direction by the motion of the movable belt 14.

The shifting range of the optical fiber 11 is so set that the optical fiber 11 is positioned at least outside on both ends of the print width of the print paper 3 at the positions designated by both the two-dot chain lines (as the virtual lines) shown in FIG. 6. The optical fiber 11 has a flexibility and the tip of the optical fiber 11 is shifted together with the fiber shifting member 13 by changing the amount of its flexure according to the movement of the fiber shifting member 13.

Further, as shown in FIG. 7, the expression $W1>D$ can be obtained, where W1 is a print width of the inkjet print head 5 in the sub scanning direction for printing per scanning, and D is an irradiation diameter of the optical fiber 11.

The mean shifting speed H1 of the tip of the optical fiber 11 in the main scanning direction is given by expression $H1 \geqq W1 \times V1/D$, where W1 is the print width of the inkjet print head 5 in the sub scanning direction, V1 is the relative speed in the main scanning direction between the inkjet print head 5 and the print paper 3, and D is the irradiation diameter of the optical fiber 11. Other components of the third embodiment are the same as those of the first embodiment.

In the configuration described above, the UV-curing type ink is ejected onto the print paper 3 through the inkjet print head 5, and the print paper 3 including the UV-curing type ink after printing is sequentially transferred in the sub scanning direction (the side of the optical fiber 11). The tip of the optical fiber 11 moves independently from the motion of the inkjet print head 5. Through the tip of the optical fiber 11 the ultraviolet light is irradiated to the target ink position in the print paper 3, so that this ink is cured in order according to the irradiation of the ultraviolet light. Accordingly, the third embodiment has the same action and effect of the first embodiment.

Furthermore, in the third embodiment, because it is possible to irradiate the ultraviolet light with reliability onto the entire area of the target ink position where the UV-curing type ink has been ejected immediately following the ejection of this ink by the inkjet print head 5 when the irradiation diameter D of the optical fiber 11 is smaller than the print width W1 of the inkjet print head 5 of a serial scanning on-demand type head in the sub scanning direction, it is possible to cure the UV-curing type ink on the entire area of the printed surface of the print paper 3 certainly.

Like the first embodiment, when the irradiation diameter D of the optical fiber 11 is equal to or greater than the print width W1 of the inkjet print head 5 in the sub scanning direction, it is possible to shift the tip of the optical fiber 11 independently from the motion of the inkjet print head 5, similar to the case of this third embodiment described above. However, like the configuration of the first embodiment, it is preferable to fix the tip of the optical fiber to the inkjet print head 5 for the reason described above.

Fourth Embodiment

Figure 8:
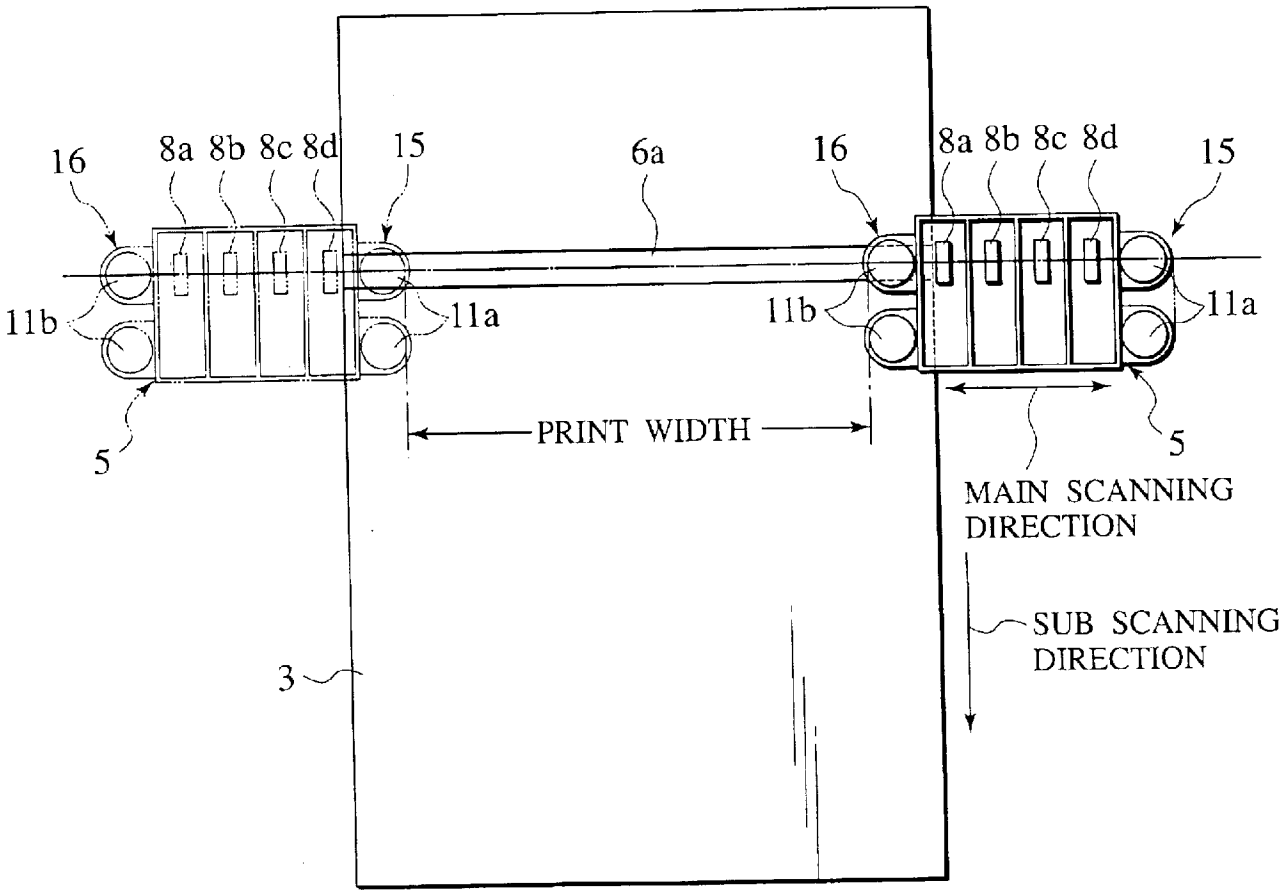
FIG. 8 is a schematic plane view showing a relationship in position between an inkjet print head and the tips of optical fiber bundles according to the fourth embodiment of the present invention.
Figure 9:
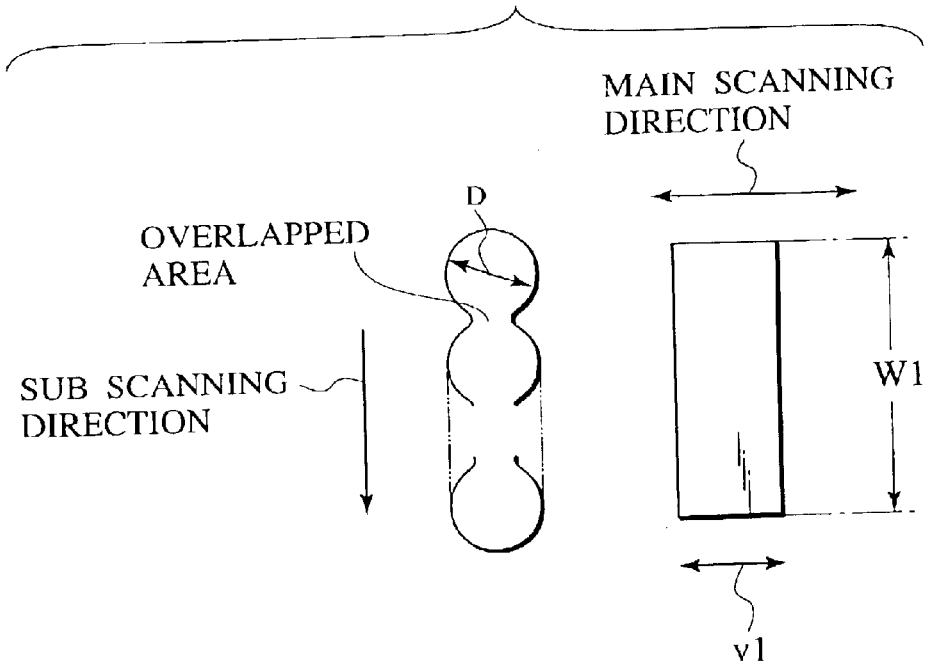
FIG. 9 is a view showing a print width of the inkjet print head and the irradiation region of the optical fibers according to the fourth embodiment of the present invention.

FIG. 8 and FIG. 9 show the fourth embodiment according to the present invention. FIG. 8 is a schematic plane view showing a relationship in position between the inkjet print head 5 and the tips of optical fiber bundles 15 and 16. FIG. 9 is a view showing a print width of the inkjet print head 5 and the irradiation region of the optical fibers.

In FIG. 8, like the first embodiment described above, the inkjet print head 5 is a serial scanning on-demand type head, and shifted in the main scanning direction by the head shifting means (not shown).

In addition, the optical fiber bundles 15 and 16 of a duplex optical fiber system to guide the ultraviolet light generated by the ultraviolet light generation section (not shown) are arranged. The tips of the optical fiber bundles 15 and 16 are fixed on both sides of the inkjet print head 5 in the main scanning direction.

The optical fiber bundles 15 and 16 comprise "n" optical fibers 11*a*, 11*b* ($n \geqq 2$), respectively. The irradiation diameter of each of the optical fibers 11*a* and 11*b* are smaller than the print width of the inkjet print head 5 in the sub scanning direction. As shown in FIG. 9, an irradiation beam of the ultraviolet light from each of the "n" optical fibers 11*a* and 11*b* is set as $W1 \leqq n \times D$, where W1 is a print width of the inkjet print head 5 in the sub scanning direction and D is an irradiation diameter D of each of the optical fibers 11*a* and 11*b*. In this case the optical fibers are arranged parallel with the sub scanning direction of the inkjet print head 5 so that the a part of the irradiation beams from both the optical fibers is overlapped to each other and the above expression "$W1 \leqq n \times D$" is also satisfied. Other components of the fourth embodiment are the same as those of the first embodiment.

In the configuration described above, when the UV-curing type ink is ejected through the inkjet print head 5 onto the print paper 3, all the tips of the optical fibers 11*a* and 11*b* are coupled in motion to the inkjet print head 5, so that the ultraviolet light is irradiated onto the target ink position in order to cure the UV-curing type ink ejected on the print paper 3. Accordingly, the fourth embodiment can obtain the same action and effect of the first embodiment.

In addition, in the fourth embodiment, in a case where the irradiation diameter D of each optical fibers 11*a* and 11*b* is smaller than the print width W1 of the inkjet print head 5 in the sub scanning direction, it is not necessary to incorporate any additional fiber carrying means in addition to the shifting means for the inkjet print head 5 because it is possible to irradiate the ultraviolet light onto the entire region of the target ink position where the UV-curing type ink has been ejected immediately following the ejection of this UV-curing type ink.

In the fourth embodiment, although all of the optical fibers 11*a* and 11*b* are arranged on both ends of the inkjet print head 5, it is also acceptable to arrange the optical fibers 11*a* (or 11*b*) only at one end of the inkjet print head 5. In this case, in order to adjust this configuration to the inkjet print head 5 performing the reciprocating motion in the main scanning direction, the irradiation position of the ultraviolet light to be irradiated through all the optical fibers 11*a* (or 11*b*) must be changed according to the direction of the scanning of the inkjet print head 5 so that the ultraviolet light is irradiated effectively to the target ink position immediately following the ejection of the UV-curing type ink.

In a case where the inkjet print head 5 performs the printing along only one direction in the main scanning direction, it goes without saying that it is not necessary to change the irradiation position of the ultraviolet light to be irradiated through the optical fibers 11*a* (or 11*b*).

Fifth Embodiment

Figure 10:
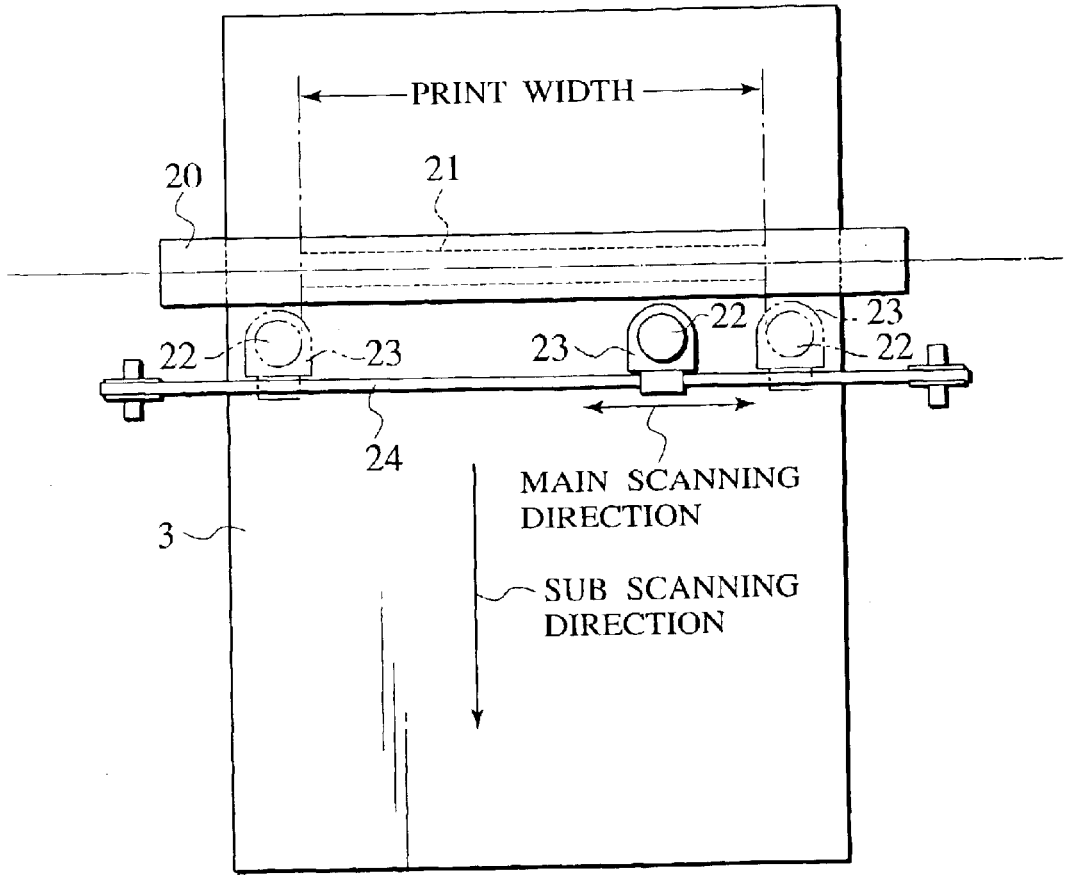
FIG. 10 is a schematic plane view showing a relationship in position between an inkjet print head and the tip of an optical fiber according to the fifth embodiment of the present invention.
Figure 11:
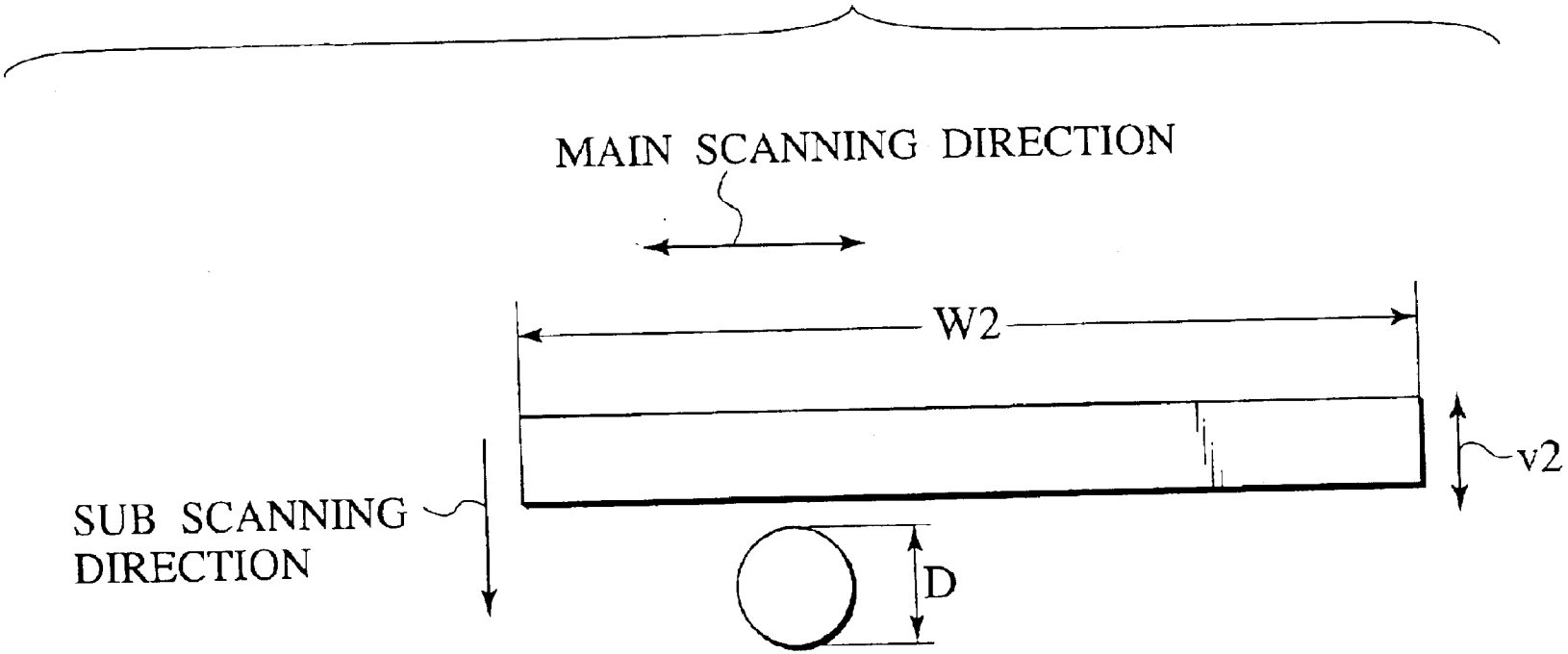
FIG. 11 is a view showing a print width of the inkjet print head and an irradiation diameter of the optical fiber according to the fifth embodiment of the present invention.

FIG. 10 and FIG. 11 show the fifth embodiment of the present invention. FIG. 10 is a schematic plane view showing a relationship in position between an inkjet print head 20 and the tip of an optical fiber 22. FIG. 11 is a view showing a print width of the inkjet print head 20 per scanning and an irradiation diameter of the optical fiber 22.

In FIG. 10, the inkjet print head 20 is a line scanning on-demand type head, and is fixed so that it does not move in any direction in the main scanning direction and the sub scanning direction. The inkjet print head 20 has a nozzle head section 21 of the length of the print width. This nozzle head section 21 is arranged per UV-curing type ink of each color, yellow, magenta, cyan, and black so that each ink can be ejected onto the print paper 3.

The ultraviolet irradiation device (not shown) as a photo-irradiation device comprises an ultraviolet light generation section (not shown) for generating the ultraviolet light and the optical fiber 22 as a single optical system through which the ultraviolet light generated by the ultraviolet light generation section is guided. The tip of the optical fiber 22 is fixed to the fiber shifting member 23 arranged at the downstream side in the sub scanning direction of the inkjet print head 20.

The fiber shifting member 23 is fixed to a movable belt 24. According to the movement of the movable belt 24, the fiber shifting member 23 is movable in the main scanning direction.

At the position designated by both the two-dot chain lines (as the virtual lines at the right and left sides) shown in FIG. 10, the shifting range of the optical fiber 22 is so set that it is positioned at least outside of the print width in the print paper 3. The optical fiber 22 has a flexibility. The tip of the optical fiber 22 is shifted together with the fiber shifting member 23 by changing the amount of its flexure according to the movement of the fiber shifting member 23.

As shown in FIG. 11, the mean shifting speed H2 of the tip of the optical fiber 22 in the main scanning direction is given by expression $H2 \geqq W2 \times V2/D$, where W2 is the print width of the inkjet print head in the main scanning direction, V2 is a relative speed between the inkjet print head 20 and the print paper 3 as the print media in the sub scanning direction, and D is the irradiation diameter of the optical fiber 22.

In the configuration described above, the UV-curing type ink is ejected onto the print paper 3 through the inkjet print head 20, and the print paper 20 on which the ink has been ejected is sequentially transferred in the sub scanning direction (the side of the optical fiber 22). The ultraviolet light is irradiated onto the target ink position onto which the UV-curing type ink has been ejected by shifting the optical fiber 22 in the main scanning direction, so that the UV-curing type ink ejected on the print paper 3 is thereby cured in order immediately following the ejection of the UV-curing type ink.

Accordingly, in the inkjet printer of the fifth embodiment it is not necessary to incorporate any carrying means for carrying the print paper 3 after the completion of the printing process. On the contrary, the conventional inkjet printer must incorporate the carrying means. In the inkjet printer of the fifth embodiment it is therefore possible to reduce the total printing time. In general, because the ink of low viscosity is widely used from the standpoint of the easy ink-ejection, the ink is easily blurred. However, because the ultraviolet light is irradiated onto the target ink position immediately following the ejection of the UV-curing type ink, even if it uses an UV-curing type ink of low viscosity, it is possible to prevent any occurrence of the blur of the ink. The present invention can provide the printed matter without disturbance even if the user touches it immediately following the printing.

In the fifth embodiment, the ultraviolet irradiation device comprises the ultraviolet light generation section for generating the ultraviolet light and the optical fiber 22 through which the ultraviolet light generated by the ultraviolet light generation section is guided to the position close to the inkjet print head 20. Because the ultraviolet light is irradiated through the tip of the optical fiber 22 and the beam of ultraviolet light can be irradiated onto a narrow area of the target ink position with a distance close to the print paper 3, it is possible to adequately irradiate the ultraviolet light of a predetermined amount even if the ultraviolet irradiation device of a small power is used. Therefore it is sufficient to use the ultraviolet irradiation device of a small size and low power consumption, and to be manufactured with a low cost.

In the fifth embodiment, the tip of the optical fiber 22 are coupled in motion to the printing speed (that is equal to the paper feeding speed in the fifth embodiment) of the inkjet print head 20 and is shifted in the main scanning direction immediately following the ejection of the UV-curing type ink at the target ink position onto which the ink has been ejected. Accordingly, because it is not necessary to shift the ultraviolet light generation section and it is enough to shift only the tip of the optical fiber 22, it is easily achieved to control the irradiation of the ultraviolet light following the ejection of the UV-curing type ink.

Furthermore, in the fifth embodiment, the mean shifting speed H2 of the tip of the optical fiber 22 in the main scanning direction is given by expression $H2 \geqq W2 \times V2/D$, where W2 is the print width of the inkjet print head 20 in the main scanning direction, V2 is a relative speed in the sub scan direction between the inkjet print head 20 and the print paper 3 as a print media, and D is the irradiation diameter of the optical fiber 22. Because it is possible to irradiate the ultraviolet light onto the entire area of the target ink position of the UV-curing type ink immediately following the ejection of the UV-curing type ink by the inkjet print head 20, it is possible to cure the UV-curing type ink printed on the entire surface of the print paper 3.

Moreover, in the fifth embodiment, although the inkjet print head 20 is fixed in the sub scanning direction, it is acceptable to have a configuration in which the inkjet print head 20 is movable in the sub scanning direction and the print paper 3 is fixed, not shifted in position.

Sixth Embodiment

Figure 12:
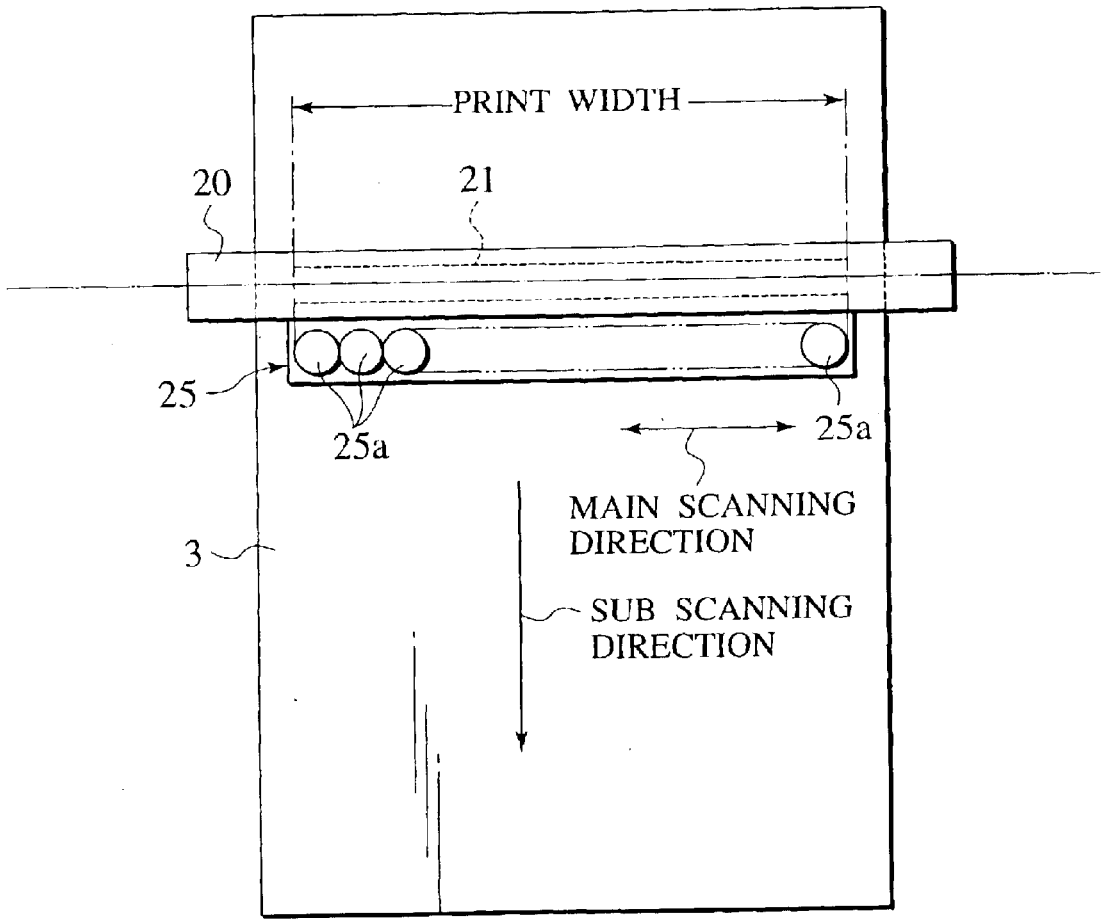
FIG. 12 is a schematic plane view showing a relationship in position between an inkjet print head and the tips of an optical fiber bundle according to the sixth embodiment of the present invention.
Figure 13:
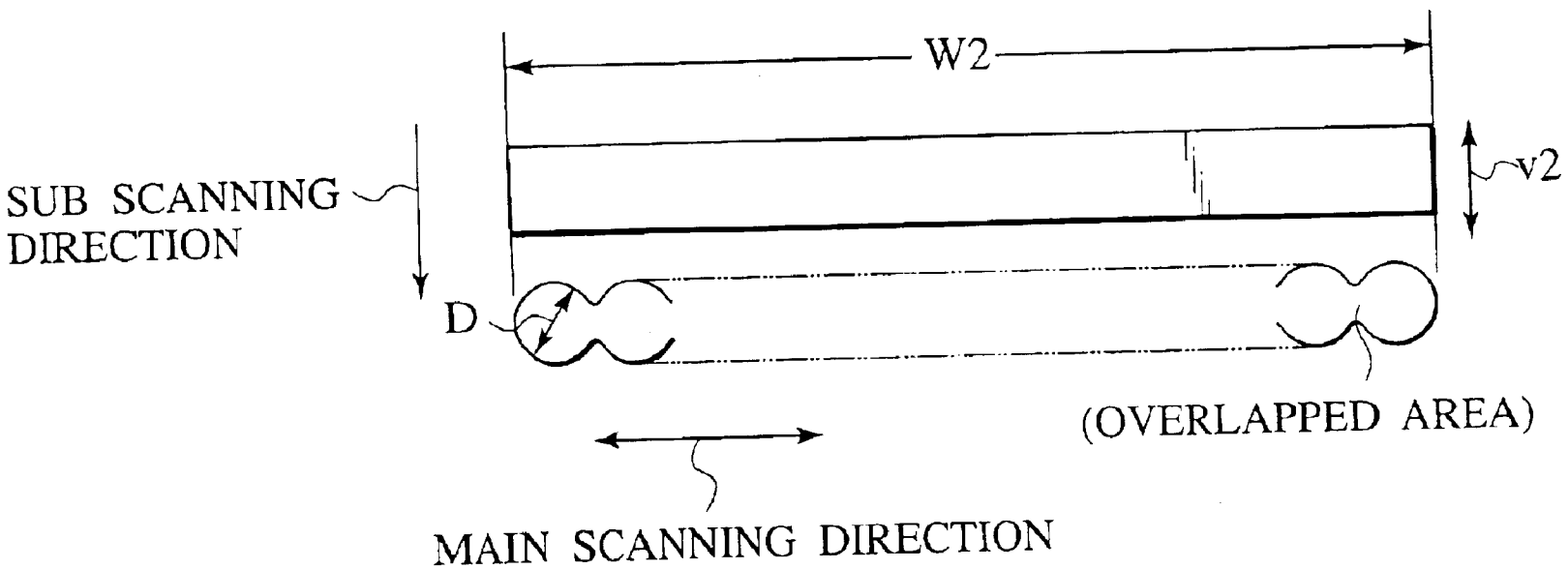
FIG. 13 is a view showing a print width of the inkjet print head per scanning and the irradiation region of the optical fibers according to the sixth embodiment of the present invention.

FIG. 12 and FIG. 13 show the sixth embodiment of the present invention. FIG. 12 is a schematic plane view showing a relationship in position between an inkjet print head 20 and the tips of optical fiber bundle 25. FIG. 13 is a view showing a print width of the inkjet print head 20 per scanning and the irradiation region of the optical fiber 25*a*.

In FIG. 12, like the fifth embodiment, the inkjet print head 20 is a line scanning on-demand type head and fixed, so that it does not move in any direction. The inkjet print head 20 has a nozzle head section 21 of the length of the print width.

The ultraviolet irradiation device (not shown) as a photo-irradiation device comprises an ultraviolet light generation section (not shown) for generating the ultraviolet light and the optical fiber bundle 25 through which the ultraviolet light generated by the ultraviolet light generation section is guided.

This optical fiber bundle 25 comprise "m" optical fibers 25*a* ($m \geqq 2$). The "m" optical fibers 25*a* are fixed to the position close to the downstream side of the sub scanning direction of the inkjet print head 20, and they are arranged parallel with the main scanning direction that the expression "$m \times D \geqq W2$" is satisfied, where W2 is a print width of the inkjet print head 20 in the main scanning direction and D is an irradiation diameter of the optical fiber 25*a*, as shown in FIG. 13. In detail, a part of a beam of ultraviolet light from each of adjacent optical fibers 25*a* is overlapped so as to satisfy the expression "$m \times D \geqq W2$". Other components of the sixth embodiment are the same as those of the fifth embodiment.

In the configuration described above, the UV-curing type ink is ejected onto the print paper 3 through the inkjet print head 20, and the print paper 3 on which the ink has been ejected in order is transferred in the sub scanning direction (the side of the optical fibers 25*a*). The ultraviolet light is irradiated onto the target ink position onto which the UV-curing type ink has been ejected through all of the optical fibers 25*a* arranged parallel with the main scanning direction, so that the UV-curing type ink ejected on the print paper 3 is cured in order immediately following the ejection of the UV-curing type ink. Accordingly, the sixth embodiment has the same action and effect of the fifth embodiment described above.

Furthermore, in the sixth embodiment, when the inkjet print head 20 is a line scanning on-demand type head and the tips of the optical fibers 25*a* are fixed to the inkjet print head 20, it is possible to irradiate the ultraviolet light onto the entire area of the target ink position onto which the UV-curing type ink has been ejected immediately following the ejection of the UV-curing type ink.

Moreover, in the sixth embodiment, although the inkjet print head 20 is fixed in the sub scanning direction, it is acceptable to have a configuration in which the inkjet print head 20 is movable in the sub scanning direction and the print paper 3 is fixed, not shifted in position.

Further, in the first to fourth embodiments described above, it has been shown that the photo-curing type ink is the UV-curing type ink and photo-irradiation device is the ultraviolet irradiation device A. However, it is also possible to apply the present invention to a photo-curing type ink which is cured by an irradiating light other than the ultraviolet light.

Moreover, in the first to sixth embodiments described above, it has been shown that the inkjet print heads 5 and 20 have plural nozzle heads 8*a* to 8*d* for color printing, it is possible to apply the concept of the present invention to mono-color inkjet printers having a single nozzle inkjet print head.

As set forth in detail, according to the inkjet printer of the present invention, when a photo-curing type ink is ejected through the inkjet print head onto a print media, the light follows a target ink position, onto which the ink has been ejected, and so that the photo-curing type ink is cured. Thereby, it is not necessary to incorporate any shifting means to shift the print media to the photo-irradiation device after the printing process. This can reduce the total time of the printing process. In addition, because in general the ink of low viscosity is used considering from the ejection function of the inkjet print head, the ink is easily blurred in the print media. In the present invention, in order to cure the photo-curing type ink, the light is irradiated onto the target ink position immediately following the ejection of the photo-curing type ink. Therefore even if a photo-curing type ink of low viscosity is used, no blur occurs in the print media. Further, even if the user touches the printed surface of the print media immediately following the printing, the image is not disturbed. In addition, for the similar reason, when a print media of easy-blur property is used, no blur phenomenon occurs in the print media. It is therefore possible to obtain the print media of anti-disturbance function.

In addition, according to the ink curing method of the present invention, when a photo curing type ink is ejected onto a print media through the inkjet print head, in order to cure the photo-curing type ink, a beam of light follows a target ink position onto which the ink has been ejected. Thereby, it is not necessary to incorporate any shifting means to shift the print media to the photo-irradiation device after the printing process. This can reduce the total time of the printing process. In addition, because in general the ink of low viscosity is used considering from the ejection function of the inkjet print head, the ink is easily blurred in the print media. In the present invention, in order to cure the photo-curing type ink, the light is irradiated onto the target ink position immediately following the ejection of the photo-curing type ink. Therefore even if a photo-curing type ink of low viscosity is used, no blur occurs in the print media. Further, even if the printed surface of the print media is touched immediately following the printing, the image is not disturbed. In addition, for the similar reason, when a print media of easy-blur property is used, no blur phenomenon occurs in the print media. It is therefore possible to obtain the print media of anti-disturbance function.

Furthermore, according to the inkjet printer and ink curing method of the present invention, because the photo-curing type ink is an UV-curing type ink and the photo-irradiation device is an ultraviolet irradiation device for irradiating ultraviolet light, it is possible to obtain the same effect described above by irradiating the ultraviolet light directly onto the print media immediately following the ejection of the ink.

Moreover, according to the inkjet printer and the ink curing method of the present invention, because the beam of the ultraviolet light is irradiated from a position close to the print media to the target ink position on the print media, in addition to the effects described above, it is possible to adequately provide the ultraviolet light of a desired amount to the target ink position even if the ultraviolet irradiation device of low power is used. Therefore it is possible to use adequately the ultraviolet irradiation device of a small size and low power consumption, which can be manufactured with a low cost.

In addition, according to the inkjet printer and the ink curing method of the present invention, in addition to the effects described above, because it is not necessary to shift the ultraviolet light generation device and it is enough to shift only the tips of the optical fibers, it is possible to easily perform the irradiation of the ultraviolet light while following the ejection of the ink.

Furthermore, according to the inkjet printer and the ink curing method of the present invention, in addition to the effects described above, it is possible to cure the UV-curing type ink with reliability because the ultraviolet light can be irradiated through the inkjet print head as the serial scanning on-demand type head onto the entire area of the printed surface immediately following the ejection of this ink through the inkjet print head.

Moreover, according to the inkjet printer and the ink curing method of the present invention, in addition to the effects described above, it is possible to cure the UV-curing type ink with reliability because the ultraviolet light can be irradiated through the inkjet print head as the line scanning on-demand type head onto the entire area of the printed surface immediately following the ejection of this ink through the inkjet print head.

In addition, according to the inkjet printer and the ink curing method of the present invention, in addition to the effects described above, because it is not necessary to incorporate any additional fiber shifting means to shift the tips of them, it is possible to prevent increasing of the number of parts and possible to easily control the printing process.

Moreover, according to the inkjet printer and the ink curing method of the present invention, in addition to the effects described above, when the optical fibers of a duplex fiber system perform each corresponding one-way irradiation in a case where the inkjet print head performs a reciprocal printing in the main scanning direction, it is possible to irradiate the ultraviolet light to the entire print width in the main scanning direction immediately following the ejection of the ink even if the inkjet print head scans in each direction. Therefore it is possible to cure the UV-curing type ink certainly without changing of the irradiation position of the ultraviolet light through the tips of the optical fibers.

Furthermore, according to the inkjet printer and the ink curing method of the present invention, in addition to the effects described above, in a case where the irradiation diameter of one optical fiber is smaller than the print width of the inkjet print head in the sub scanning direction, even if the tips of the optical fibers are fixed to the inkjet print head, it is not necessary to incorporate any additional fiber shifting means in addition to the shifting means for shifting the inkjet print head because the ultraviolet light can be irradiated onto the entire area of the target print position, onto which the ink has been ejected, immediately following the ejection of the ink through the inkjet print head.

Moreover, according to the inkjet printer and the ink curing method of the present invention, in addition to the effects described above, in a case where the inkjet print head is a line scanning on-demand type head, when the tips of the optical fibers are fixed to the inkjet print head, it is not necessary to incorporate any additional fiber shifting means in addition to the shifting means for shifting the inkjet print head because the ultraviolet light can be irradiated to the entire area of the target print position, onto which the ink has been ejected, immediately following the ejection of the ink through the inkjet print head.

INDUSTRIAL APPLICABILITY

As described above, according to the inkjet printer and the ink curing method of the present invention, it is not necessary to incorporate any shifting means for shifting a print media after printing process. Accordingly, the present invention can reduce the total time of the printing process, and provide the inkjet printer and the ink curing method using the ultraviolet irradiation device of a small size and low power consumption, and manufactured with a low cost.

What is claimed is:

1. An inkjet printer having an inkjet print head through which a photo-curing type ink is ejected onto a print media in a printing process, comprising: a photo-irradiation device irradiating a beam of light to a target ink position on the print media onto which the photo-curing type ink has been ejected following the election of the photo-curing type ink through the inkjet print head;

wherein the photo-curing type ink is an UV-curing type ink, and the photo-irradiation device is an ultraviolet irradiation device;

the ultraviolet irradiation device comprises: an ultraviolet light generation section for generating the ultraviolet light; and one or more optical fibers through which the ultraviolet light generated by the ultraviolet light generation section is guided to a position close to the inkjet print head, the ultraviolet irradiation device irradiates the ultraviolet light onto the print media through the tips of the optical fibers; and the tips of the optical fibers are coupled in motion to the print speed of the inkjet print head and are set movably in a main scanning direction of the inkjet print head so that the ultraviolet light is irradiated onto the target ink position on the print media immediately following the ejection of the UV-curing type ink; and wherein when the inkjet print head is a serial scanning on-demand type head, a mean shifting speed H1 of the tip of each optical fiber in the main scanning direction of the inkjet print head is given by the expression $H1 \geqq W1 \times V1/D$, wherein W1 is a print width in a sub scanning direction, V1 is a relative speed between the inkjet print head and the print media in the main scanning direction, and D is an irradiation diameter of each optical fiber.

2. The inkjet printer according to claim 1, wherein "n" optical fibers are arranged parallel at least one end of the inkjet print head with the main scanning direction so as to satisfy the expression $W1 \leqq n \times D$ under the condition of $W1 > D$, where W1 is a print width in the sub scanning direction of the inkjet print head, and D is an irradiation diameter of each optical fiber.

3. An inkjet printer having an inkjet print head through which a photo-curing type ink is ejected onto a print media in a printing process, comprising; a photo-irradiation device irradiating a beam of light to a target ink position on the print media onto which the photo-curing type ink has been ejected following the ejection of the photo-curing type ink through the inkjet print head;

wherein the photo-curing type ink is an UV-curing type ink, and the photo-irradiation device is an ultraviolet irradiation device;

the ultraviolet irradiation device comprises: an ultraviolet light generation section for generating the ultraviolet light; and one or more optical fibers through which the ultraviolet light generated by the ultraviolet light generation section is guided to a position close to the inkjet print head, the ultraviolet irradiation device irradiates the ultraviolet light onto the print media through the tips of the optical fibers; and the tips of the optical fibers are coupled in motion to the print speed of the inkjet print head and are set movable in a main scanning direction of the inkjet print head so that the ultraviolet light is irradiated onto the target ink position on the print media immediately following the election of the UV-curing type ink; and wherein when the inkjet print head is a line scanning on-demand head, a mean shifting speed H2 of the tip of each optical fiber in the main scanning direction of the inkjet print head is given by the expression $H2 \geqq W2 \times V2/D$, wherein W2 is a print width in the main scanning direction, V2 is a relative speed between the inkjet print head and the print media in a sub scanning direction, and D is an irradiation diameter of each optical fiber.

4. The inkjet printer according to claim 3 wherein "m" optical fibers are arranged parallel at the downstream side with the main scanning direction of the inkjet print head so as to satisfy the expression $m \times D \geqq W2$, where W2 is a print width in the main scanning direction of the inkjet print head, and D is an irradiation diameter of each optical fiber.

5. An inkjet printer having an inkjet print head through which a photo-curing type ink is ejected onto a print media in a printing process, comprising: a photo-irradiation device irradiating a beam of light to a target ink position on the print media onto which the photo-curing type ink has been ejected following the ejection of the photo-curing type ink through the inkjet print head;

wherein the photo-curing type ink is an UV-curing type ink, and the photo-irradiation device is an ultraviolet irradiation device;

the ultraviolet irradiation device comprises: an ultraviolet light generation section for generating the ultraviolet light; and one or more optical fibers through which the ultraviolet light generated by the ultraviolet light generation section is guided to a position close to the inkjet print head, the ultraviolet irradiation device irradiates the ultraviolet light onto the print media through the tips of the optical fibers; and the tips of the optical fibers are coupled in motion to the print speed of the inkjet print head and are set movably in a main scanning direction of the inkjet print head so that the ultraviolet light is irradiated onto the target ink position on the print media immediately following the ejection of the UV-curing type ink; and wherein the inkjet print head is a serial scanning on-demand type head, and the irradiation diameter of each optical fiber is equal to or greater than the print width of the inkjet print head in the sub scanning direction per scanning of the inkjet print head, and the tip of each optical fiber is fixed to the inkjet print head in order to shift them together.

6. The inkjet printer according to claim 5, wherein the optical fibers are a duplex optical fiber system, and the tips of the optical fibers in the duplex optical fiber system are set on both ends of the inkjet print head in the main scanning direction.

7. An ink curing method of an inkjet printer having an inkjet print head comprising:

ejecting a photo-curing type ink on a print media through the inkjet print head;

irradiating a beam of light by a photo-irradiation device to a target ink position on the print media onto which the photo-curing type ink has been ejected by the photo-irradiation device immediately following the ejection of the photo-curing type ink in order to cure the photo-curing type ink at the target ink position on the print media;

wherein the photo-curing type ink is an UV-curing type ink, and the photo-irradiation device is an ultraviolet irradiation device;

the ultraviolet irradiation device comprises:

an ultraviolet light generation section for generating the ultraviolet light; and one or more optical fibers through which the ultraviolet light is guided to a position close to the inkjet print head, and the ultraviolet light is irradiated through the tips of the optical fibers;

the tips of the optical fibers are coupled in motion to a print speed of the inkjet print head and are set movably in a main scanning direction so that the ultraviolet light is irradiated onto the target ink position on the print media immediately following the ejection of the UV-curing type ink; and wherein when the inkjet print head is a serial scanning on-demand type head, a mean shifting speed H1 of the tip of each optical fiber in the main scanning direction of the inkjet print head is given by the expression $H1 \geqq W1 \times V1/D$, wherein W1 is a print width in a sub scanning direction, V1 is a relative speed between the inkjet print head and the print media in the main scanning direction, and D is an irradiation diameter of each optical fiber.

8. The ink curing method according to claim 7, wherein "n" optical fibers are arranged parallel at least one end of the inkjet print head with the main scanning direction so as to satisfy the expression $W1 \leqq n \times D$ under the condition of $W1 > D$, where W1 is a print width in the sub scanning direction of the inkjet print head, and D is an irradiation diameter of each optical fiber.

9. An ink curing method of an inkjet printer having an inkjet print head comprising;

ejecting a photo-curing type ink on a print media through the inkjet print head;

irradiating a beam of light by a photo-irradiation device to a target ink position on the print media onto which the photo-curing type ink has been ejected by the photo-irradiation device immediately following the ejection of the photo-curing type ink in order to cure the photo-curing type ink at the target ink position on the print media;

wherein the photo-curing type ink is an UV-curing type ink, and the photo-irradiation device is an ultraviolet irradiation device;

the ultraviolet irradiation device comprises;

an ultraviolet light generation section for generating the ultraviolet light; and one or more optical fibers through which the ultraviolet light is guided to a position close to the inkjet print head, and the ultraviolet light is irradiated through the tips of the optical fibers;

the tips of the optical fibers are coupled in motion to a print speed of the inkjet print head and are set movably in a main scanning direction so that the ultraviolet light is irradiated onto the target ink position on the print media immediately following the ejection of the UV-curing type ink; and wherein when the inkjet print head is a line scanning on-demand type head, a mean shifting speed H2 of the tip of each optical fiber in the main scanning direction of the inkjet print head is given by the expression $H2 \geqq W2 \times V2/D$, wherein W2 is a print width in the main scanning direction, V2 is a relative speed between the inkjet print head and the print media in a sub scanning direction, and D is an irradiation diameter of each optical fiber.

10. The ink curing method according to claim 9, wherein "m" optical fibers are arranged parallel at the downstream side with the main scanning direction of the inkjet print head so as to satisfy the expression $m \times D \geqq W2$, where W2 is a print width in the main scanning direction of the inkjet print head, and D is an irradiation diameter of each optical fiber.

11. An ink curing method of an inkjet printer having an inkjet print head comprising:

ejecting a photo-curing type ink on a print media through the inkjet print head;

irradiating a beam of light by a photo-irradiation device to a target ink position on the print media onto which the photo-curing type ink has been ejected by the photo-irradiation device immediately following the ejection of the photo-curing type ink in order to cure the photo-curing type ink at the target ink position on the print media;

wherein the photo-curing type ink is an UV-curing type ink, and the photo-irradiation device is an ultraviolet irradiation device;

the ultraviolet irradiation device comprises:

an ultraviolet light generation section for generating the ultraviolet light; and one or more optical fibers through which the ultraviolet light is guided to a position close to the inkjet print head, and the ultraviolet light is irradiated through the tips of the optical fibers;

wherein the tips of the optical fibers are coupled in motion to a print speed of the ink jet print head and are set movably in a main scanning direction so that the ultraviolet light is irradiated onto the target ink position on the print media immediately following the ejection of the UV-curing type ink; and wherein the inkjet print head is a serial scanning on-demand type head, and the irradiation diameter of each optical fiber is equal to or greater than the print width of the inkjet print head in the sub scanning direction per scanning of the inkjet print head, and the tip of each optical fiber is fixed to the inkjet print head in order to shift them together.

12. The ink curing method according to claim 11, wherein the optical fibers are a duplex optical fiber system, and the tips of the optical fibers in the duplex optical fiber system are set on both ends of the inkjet print head in the main scanning direction.

* * * * *

UNITED STATES PATENT AND TRADEMARK OFFICE

CERTIFICATE OF CORRECTION

PATENT NO. : 6,857,734 B2
DATED : February 22, 2005
INVENTOR(S) : Yamamoto

It is certified that error appears in the above-identified patent and that said Letters Patent is hereby corrected as shown below:

Column 17,
Line 28, please delete ";" and replace with -- : --
Line 47, please delete "movable" and replace with -- movably --
Line 60, please delete "claim 3 wherein" and replace with -- claim 3, wherein --

Signed and Sealed this

Tenth Day of May, 2005

JON W. DUDAS
*Director of the United States Patent and Trademark Office*